US009211573B2

(12) United States Patent
Hayashi et al.

(10) Patent No.: US 9,211,573 B2
(45) Date of Patent: Dec. 15, 2015

(54) HOT ROLLING EQUIPMENT AND HOT ROLLING METHOD

(75) Inventors: Kanji Hayashi, Hiroshima (JP); Shuji Maniwa, Hiroshima (JP); Hideaki Furumoto, Hiroshima (JP); Shinya Kanemori, Hiroshima (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 325 days.

(21) Appl. No.: 13/997,005

(22) PCT Filed: Dec. 24, 2010

(86) PCT No.: PCT/JP2010/073270

§ 371 (c)(1),
(2), (4) Date: Sep. 12, 2013

(87) PCT Pub. No.: WO2012/086043

PCT Pub. Date: Jun. 28, 2012

(65) Prior Publication Data

US 2014/0007637 A1 Jan. 9, 2014

(51) Int. Cl.

| | |
|---|---|
| ***B21B 37/28*** | (2006.01) |
| ***B21B 1/26*** | (2006.01) |
| ***B21B 37/68*** | (2006.01) |
| *B21B 37/62* | (2006.01) |
| *B21B 38/00* | (2006.01) |

(52) U.S. Cl.

CPC . *B21B 1/26* (2013.01); *B21B 37/28* (2013.01); *B21B 37/68* (2013.01); *B21B 37/62* (2013.01); *B21B 38/00* (2013.01); *B21B 2263/02* (2013.01); *B21B 2273/04* (2013.01)

(58) Field of Classification Search

CPC ..... B21B 1/26; B21B 37/68; B21B 37/28; B21B 37/62; B21B 38/00; B21B 2263/02; B21B 2273/04

USPC ..... 72/8.1, 8.3, 9.1, 11.7, 31.09, 365.2

See application file for complete search history.

(56) References Cited

U.S. PATENT DOCUMENTS

| | | | | |
|---|---|---|---|---|
| 3,940,960 | A * | 3/1976 | Tanifuji et al. | 72/14.4 |
| 4,056,957 | A * | 11/1977 | Howard | 72/14.4 |
| 4,137,742 | A * | 2/1979 | Tanifuji et al. | 72/9.4 |

(Continued)

FOREIGN PATENT DOCUMENTS

| | | | |
|---|---|---|---|
| JP | 63-123511 | A | 5/1988 |
| JP | 10-34220 | A | 2/1998 |
| JP | 2003-275811 | A | 9/2003 |

(Continued)

*Primary Examiner* — David B Jones

(74) *Attorney, Agent, or Firm* — Birch, Stewart, Kolasch & Birch, LLP

(57) ABSTRACT

Provided are hot rolling equipment and a hot rolling method for precisely controlling the meandering and plate shape of a steel strip, thereby making it possible to prevent tail end squeezing of the steel strip. Hot rolling equipment (10) for this purpose, for sequentially passing a steel strip (1) through rolling machines (11, 12) and thereby rolling the steel strip (1), wherein a plurality of split rolls (63) capable of contacting the steel strip (1) is provided between the rolling machines (11, 12), and, when the split rolls (63) contact the steel strip (1), detection torques (Td, Tw) acting on the left and right ends of the split rolls (63) are detected by torque detectors (67*a*, 67*b*), the reduction leveling of the rolling machines (11, 12) being adjusted on the basis of the detected detection torques (Td, Tw) to control the meandering and plate shape of the steel strip (1).

12 Claims, 8 Drawing Sheets

(56) References Cited

U.S. PATENT DOCUMENTS

| | | | | |
|---|---|---|---|---|
| 4,188,809 | A * | 2/1980 | Ishimoto et al. | 72/11.4 |
| 8,051,692 | B2 * | 11/2011 | Hayashi et al. | 72/9.1 |
| 2008/0134739 | A1 | 6/2008 | Hayashi et al. | |

FOREIGN PATENT DOCUMENTS

| | | | |
|---|---|---|---|
| JP | 2006-346714 | A | 12/2006 |
| JP | 2006-346715 | A | 12/2006 |
| JP | 4251038 | A | 4/2009 |

* cited by examiner 13
1
51
52
53
53a
54
55
56
57
63
(WS)
(DS)

HOT ROLLING EQUIPMENT AND HOT ROLLING METHOD

TECHNICAL FIELD

The present invention relates to a hot rolling line and a hot rolling method which prevent a strip from having tail pinching due to meandering.

BACKGROUND ART

In a rolling step, a strip meanders by moving outward in a width direction of a rolling mill in some cases. Generally, in a hot rolling line, multiple rolling mills are arranged in tandem and the strip is held by the rolling mills during a so-called steady rolling, that is a period from when a leading end of the strip being rolled passes the rolling mill at the last stage until the tail end of the strip enters the rolling mill at the first stage. Accordingly, significant meandering of the strip rarely occurs.

However, after the tail end of the strip passes through each of the rolling mills, the meandering of the strip suddenly begins due to a loss of the holding force applied by the rolling mill from which the strip has just left. As a result, the strip has tail pinching in which the tail end is rolled while being folded down due to reasons such as contact with a side guide provided on an entry side of the next rolling mill. Such tail pinching damages a work roll. If the rolling is continued in this state, the damage on the work roll is transferred onto the strip and the quality of the strip deteriorates. Accordingly, the work for replacement of the work roll is required. This leads to reduction in productivity and yield of the strip.

A technique of controlling the meandering of the strip during the rolling is an important technique not only from the viewpoint of preventing rolling failures such as the tail pinching described above but also from the viewpoint of stable rolling which leads to improvement in productivity and reduction in manufacturing cost. Therefore, rolling methods for controlling the meandering of the strip to prevent the meandering from causing the tail pinching have been heretofore provided, and such rolling methods are disclosed in Patent Documents 1 to 4 for example.

In Patent Document 1, a skew angle of a conveyed strip with respect to the center line of a rolling mill is detected and thereafter meandering control of the strip is performed by adjusting screw-down leveling on the basis of the detected skew angle.

Moreover, Patent Document 2 uses a tensile force measuring roll capable of coming into contact with a strip, and makes measurements of vertical forces acting on left and right ends of the tensile force measuring roll, a thrust force acting in a roll axis direction of the tensile force measuring roll, and a threading position of the strip in a strip width direction on the tensile force measuring roll. Then, a left-right tensile force difference of the strip is calculated based on the vertical forces, the thrust force, and the threading position of the strip in the strip width direction. Thereafter, meandering control of the strip is performed by adjusting screw-down leveling on the basis of the calculated left-right tensile force difference of the strip.

Furthermore, in each of Patent Documents 3 and 4, a meandering amount of a strip is calculated based on the positions of left and right strip end portions of the strip which are detected by using multiple split rolls and thereafter meandering control of the strip is performed by adjusting a roll bender amount and screw-down leveling on the basis of the calculated meandering amount of the strip.

PRIOR ART DOCUMENT

Patent Document

Patent Document 1: Japanese Patent No. 4251038
Patent Document 2: Japanese Patent Application Publication No. Hei 10-34220
Patent Document 3: Japanese Patent Application Publication No. 2006-346714
Patent Document 4: Japanese Patent Application Publication No. 2006-346715

SUMMARY OF THE INVENTION

Problems to be Solved by the Invention

In Patent Document 1, through numerical processing of a captured image of the strip, left and right edge lines of the strip are detected from two edge positions on each of the left and right sides of the strip to obtain the center line of the strip, and then the skew angle of the strip is calculated as a crossing angle between the center line of the strip and the center line of the rolling mill.

Here, the actual skew angle of the strip is very small and high detection accuracy is required to detect the skew angle. However, since the skew angle of the strip is detected based on the optically captured image, the skew angle detecting method described above tends to be affected by the surrounding environment such as cooling water and vapor, and may not achieve sufficient detection accuracy due to noises appearing in the captured image. Furthermore, in the steady rolling state where the strip is held by the rolling mills and appears not to be meandering, the detection of the meandering is difficult and it is thus impossible to control invisible factors of meandering. Moreover, in a situation where the meandering of the strip suddenly begins after the tail end thereof passes through each of the rolling mills, even if the screw-down leveling is tried to be controlled by detecting the skew angle of the strip, the rolling mill may be unable to perform the screw-down leveling operation quickly enough to follow the sudden meandering.

In Patent Document 2, the left-right tensile force difference of the strip is calculated by using four measurement values of the left and right vertical forces, the thrust force, and the threading position of the strip in the strip width direction, and the screw-down leveling is controlled to keep the calculated left-right tensile force difference at a predetermined value or below. The relational expression between a left-right vertical force difference and the left-right tensile force difference described in Patent Document 2 does not hold unless the strip is in contact with the tensile force measuring roll over the entire strip width. Accordingly, the tensile force measuring roll needs to be a long roll.

In other words, the left-right tensile force difference calculation method described above requires complicated calculation using the four measurement values, and moreover requires the measurement values to be measured accurately by using the long tensile force measuring roll. When the measurement is not performed accurately, the calculated left-right tensile force difference of the strip differs greatly from the actual one. If the screw-down leveling is controlled based on the thus-calculated left-right tensile force difference, the meandering of the strip may not be prevented sufficiently.

Furthermore, in Patent Documents 3 and 4, the meandering amount of the strip is controlled by simply detecting the left and right strip end portions of the strip. Accordingly, when there is no meandering amount, the control of the roll bender and the screw-down leveling is not performed even if there is a left-right tensile force difference or a skew angle in the strip. Thus, the meandering detection method described above may not be able to sufficiently handle sudden beginning of meandering of the strip immediately after the tail end passes through each of the rolling mills.

Moreover, there has been provided a rolling method in which shape control of the strip is performed by adjusting the screw-down leveling on the basis of the shape of the strip detected by using the multiple split rolls. In such shape control of the strip, the shape of the strip is divided into an asymmetric strip shape component and a symmetric strip shape component which indicate the strip shape, and the screw-down leveling is adjusted based on the asymmetric strip shape component of these components. However, in the shape control of the strip described above, since the thrust forces acting on the split rolls are not detected, the meandering control of the strip is not performed simultaneously.

The present invention solves the problems described above and aims to provide a hot rolling line and a hot rolling method capable of preventing tail pinching of a strip by accurately controlling the meandering and the shape of the strip.

Means for Solving the Problems

A hot rolling line according to a first aspect of the invention solving the above problems is a hot rolling line configured to roll a strip by sequentially threading the strip through a plurality of rolling mills arranged in tandem. The hot rolling line comprises: a plurality of split rolls provided at least in one of spaces between the rolling mills, the split rolls each being capable of rotating about a roll axis parallel to a work roll axis direction of the rolling mills and coming into contact with the strip; a pair of left and right torque detectors configured to detect torques acting on left and right ends of each of the split rolls respectively when the split roll comes into contact with the strip; a strip contact roll pick-out unit configured to pick out each split roll being in contact with the strip; a torque difference calculation unit configured to calculate a torque difference between the left and right ends of the split roll picked out by the strip contact roll pick-out unit; a meandering torque elimination unit configured to calculate shape torques by eliminating meandering torques respectively from the torques at the left and right ends of the split roll picked out by the strip contact roll pick-out unit, the shape torques generated at the left and right ends of the picked-out split roll by a shape of the strip, the meandering torques generated at the left and right ends of the picked-out split roll by meandering of the strip; and a screw-down leveling control unit configured to control the meandering of the strip by adjusting screw-down leveling of at least one of the rolling mills disposed upstream and downstream of the split rolls in a strip rolling direction, on the basis of the torque difference calculated by the torque difference calculation unit, and to also control the shape of the strip by adjusting the screw-down leveling of at least one of the rolling mills disposed upstream and downstream of the split rolls in the strip rolling direction, on the basis of the shape torques calculated by the meandering torque elimination unit.

The hot rolling line according to a second aspect of the invention solving the above problems further comprises a shape torque distribution regression unit configured to calculate an asymmetric strip shape component and a symmetric strip shape component which indicate the shape of the strip, by performing regression on the shape torques calculated by the meandering torque elimination unit, the regression performed by using a polynomial having a predetermined degree. In the hot rolling line, the screw-down leveling control unit controls the shape of the strip by adjusting the screw-down leveling of at least one of the rolling mills disposed upstream and downstream of the split rolls in the strip rolling direction, on the basis of the asymmetric strip shape component calculated by the shape torque distribution regression unit.

The hot rolling line according to a third aspect of the invention solving the above problems further comprises a meandering torque difference calculation unit configured to calculate a meandering torque difference caused between the left and right ends of the picked-out split roll by the meandering of the strip, on the basis of the torque difference calculated by the torque difference calculation unit as well as the asymmetric strip shape component and the symmetric strip shape component calculated by the shape torque distribution regression unit. In the hot rolling line, the screw-down leveling control unit controls the meandering of the strip by adjusting the screw-down leveling of at least one of the rolling mills disposed upstream and downstream of the split rolls in the strip rolling direction, on the basis of the meandering torque difference calculated by the meandering torque difference calculation unit.

In the hot rolling line according to a fourth aspect of the invention solving the above problems, the meandering torque difference calculation unit calculates a meandering torque difference ratio on the basis of the calculated meandering torque difference and an average value of the torques at the left and right ends of the split roll picked out by the strip contact roll pick-out unit, and the screw-down leveling control unit controls the meandering of the strip by adjusting the screw-down leveling of at least one of the rolling mills disposed upstream and downstream of the split rolls in the strip rolling direction, on the basis of the meandering torque difference ratio calculated by the meandering torque difference calculation unit.

The hot rolling line according to a fifth aspect of the invention solving the above problems further comprises a pair of upper and lower pinch rolls rotatably supported at least at one of an entry side and a delivery side of one of the rolling mills and configured to guide the strip by pinching the strip from above and below. In the hot rolling line, the split rolls are arranged between the one rolling mill and the pair of pinch rolls provided at the one of the entry side and the delivery side of the one rolling mill, and the screw-down leveling control unit controls the meandering and the shape of the strip by adjusting the screw-down leveling of at least one of the rolling mill and the pair of pinch rolls disposed upstream and downstream of the split rolls in the strip rolling direction.

In the hot rolling line according to a sixth aspect of the invention solving the above problems, the split rolls picked out by the strip contact roll pick-out unit include only split rolls being in full contact with the strip in a roll width direction or include a split roll being in full contact with the strip in the roll width direction and a split roll being in partial contact with the strip.

A hot rolling method according to a seventh aspect of the invention solving the above problems is a hot rolling method of rolling a strip by sequentially threading the strip through a plurality of rolling mills arranged in tandem, the hot rolling method comprises: bringing a plurality of split rolls into contact with the conveyed strip, the split rolls provided at least in one of spaces between the rolling mills and each rotatably supported about a roll axis parallel to a work roll axis direction of the rolling mills; detecting torques acting on left and right ends of each of the split rolls respectively when the split roll comes into contact with the strip; picking out each split roll being in contact with the strip; calculating a torque difference between the left and right ends of the picked-out split roll; calculating shape torques by eliminating meandering torques respectively from the torques at the left and right ends of the picked-out split roll, the shape torques generated at the left and right ends of the picked-out split roll by a shape of the strip, the meandering torques generated at the left and right ends of the picked-out split roll by meandering of the strip; and controlling the meandering of the strip by adjusting screw-down leveling of at least one of the rolling mills disposed upstream and downstream of the split rolls in a strip rolling direction, on the basis of the torque difference, and also controlling the shape of the strip by adjusting the screw-down leveling of at least one of the rolling mills disposed upstream and downstream of the split rolls in the strip rolling direction, on the basis of the shape torques.

The hot rolling method according to an eighth aspect of the invention solving the above problems further comprises calculating an asymmetric strip shape component and a symmetric strip shape component which indicate the shape of the strip, by performing regression on the shape torques by using a polynomial having a predetermined degree. In the hot rolling method, the shape of the strip is controlled by adjusting the screw-down leveling of at least one of the rolling mills disposed upstream and downstream of the split rolls in the strip rolling direction, on the basis of the asymmetric strip shape component.

The hot rolling method according to a ninth aspect of the invention solving the above problems further comprises calculating a meandering torque difference caused between the left and right ends of the picked-out split roll by the meandering of the strip, on the basis of the torque difference, the asymmetric strip shape component, and the symmetric strip shape component. In the hot rolling method, the meandering of the strip is controlled by adjusting the screw-down leveling of at least one of the rolling mills disposed upstream and downstream of the split rolls in the strip rolling direction, on the basis of the meandering torque difference.

The hot rolling method according to a tenth aspect of the invention solving the above problems further comprises calculating a meandering torque difference ratio on the basis of the meandering torque difference and an average value of the torques at the left and right ends of the picked-out split roll. In the hot rolling method, the meandering of the strip is controlled by adjusting the screw-down leveling of at least one of the rolling mills disposed upstream and downstream of the split rolls in the strip rolling direction, on the basis of the meandering torque difference ratio.

In the hot rolling method according to an eleventh aspect of the invention solving the above problems, a pair of upper and lower pinch rolls is provided, the pinch rolls rotatably supported at least at one of an entry side and a delivery side of one of the rolling mills and configured to guide the strip by pinching the strip from above and below, the split rolls are arranged between the one rolling mill and the pair of pinch rolls provided at the one of the entry side and the delivery side of the one rolling mill, and the meandering and the shape of the strip are controlled by adjusting the screw-down leveling of at least one of the rolling mill and the pair of pinch rolls disposed upstream and downstream of the split rolls in the strip rolling direction.

In the hot rolling method according to a twelfth aspect of the invention solving the above problems, the picked-out split rolls include only split roll being in full contact with the strip in a roll width direction or include a split roll being in full contact with the strip in the roll width direction and a split roll being in partial contact with the strip.

Effect of the Invention

The hot rolling line and the hot rolling method of the present invention can accurately control the meandering and the shape of the strip by: detecting the torques acting on the left and right ends of each of the split rolls respectively when the split roll comes into contact with the strip; calculating the torque difference and the shape torques by using the detected left and right torques; controlling the meandering of the strip on the basis of the torque difference; and controlling the shape of the strip on the basis of the shape torques. Accordingly, the tail pinching of the strip can be prevented.

Figures 2A, 2B, 2C:
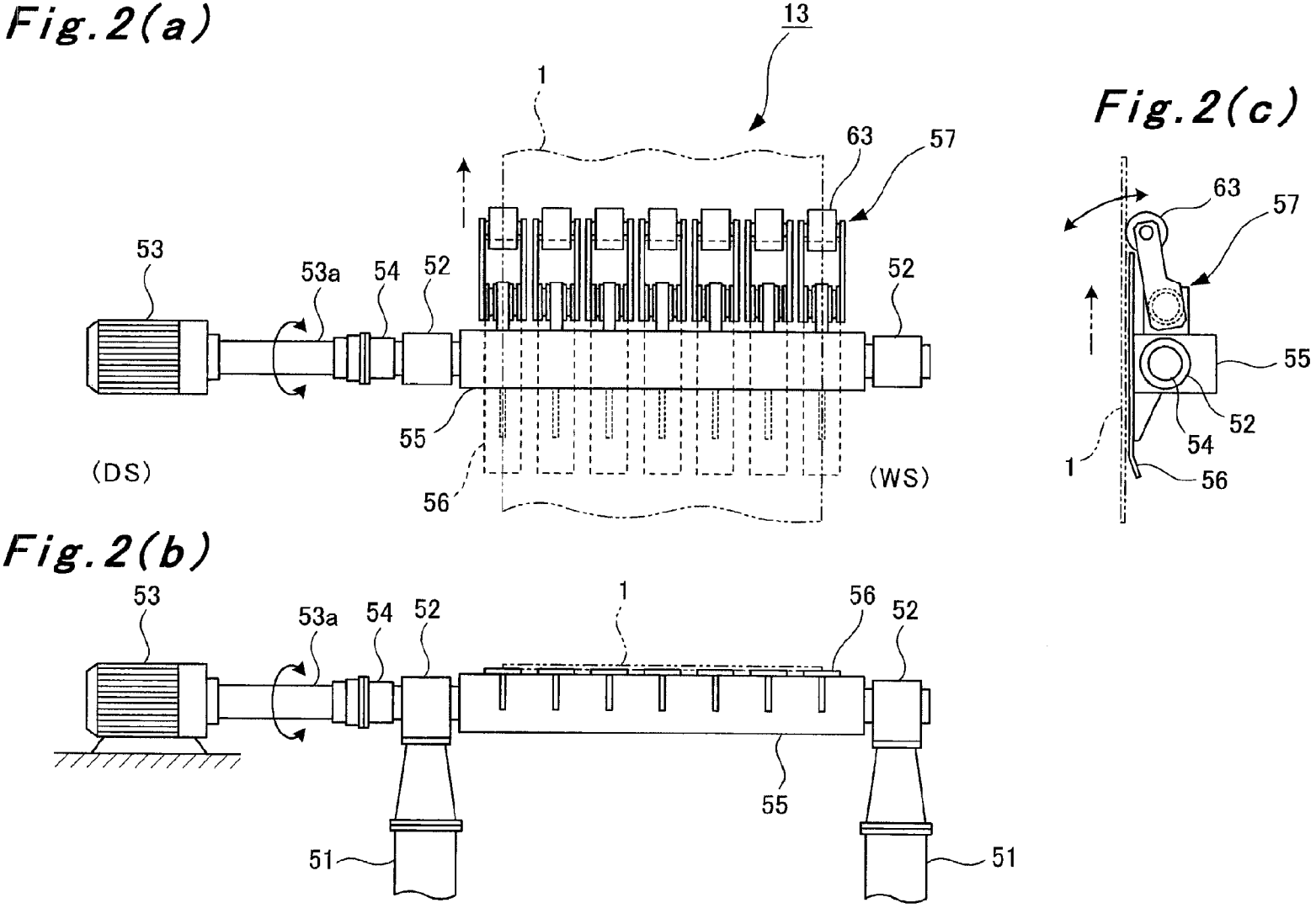

Part (a) of FIG. 2 is a plan view of a strip shape detection device, part (b) of FIG. 2 is a front view of the strip shape detection device, and part (c) of FIG. 2 is a side view of the strip shape detection device.

Figure 3:
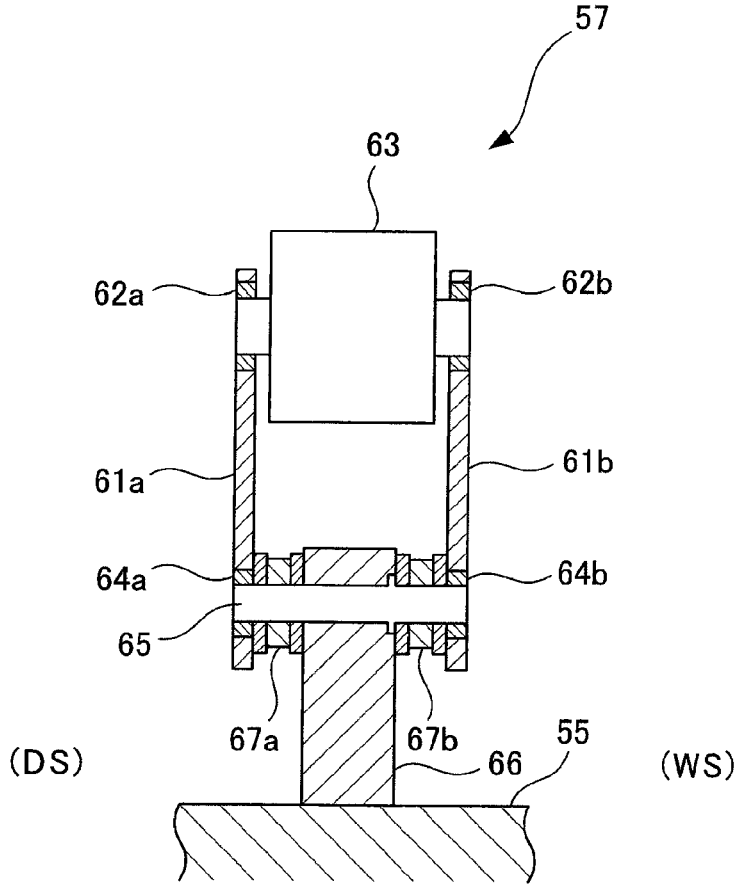

FIG. 3 is a schematic configuration diagram of a roll unit.

Figure 4:
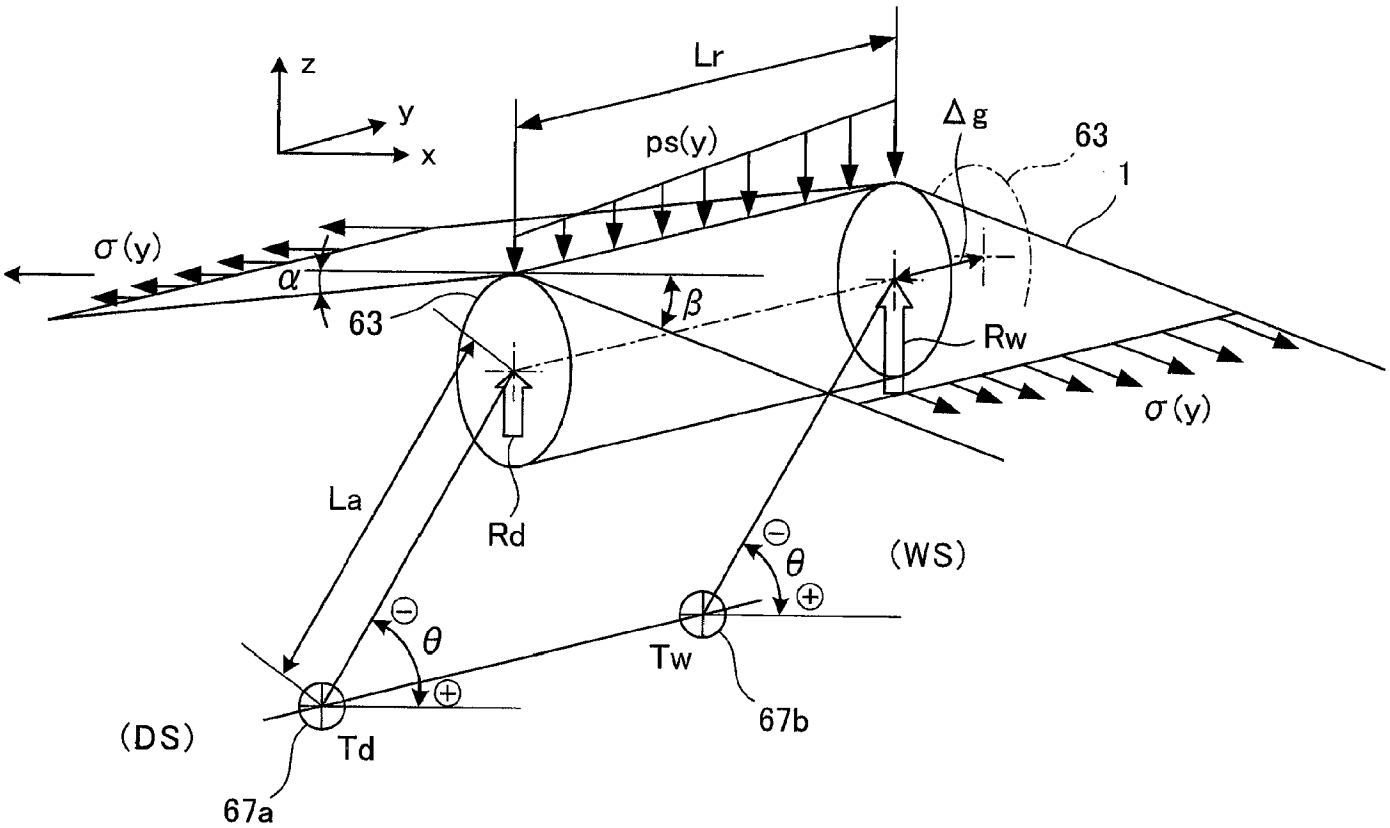

FIG. 4 is a view explaining how a torque difference between left and right ends of a split roll is caused by a shape of a strip.

Figure 5:
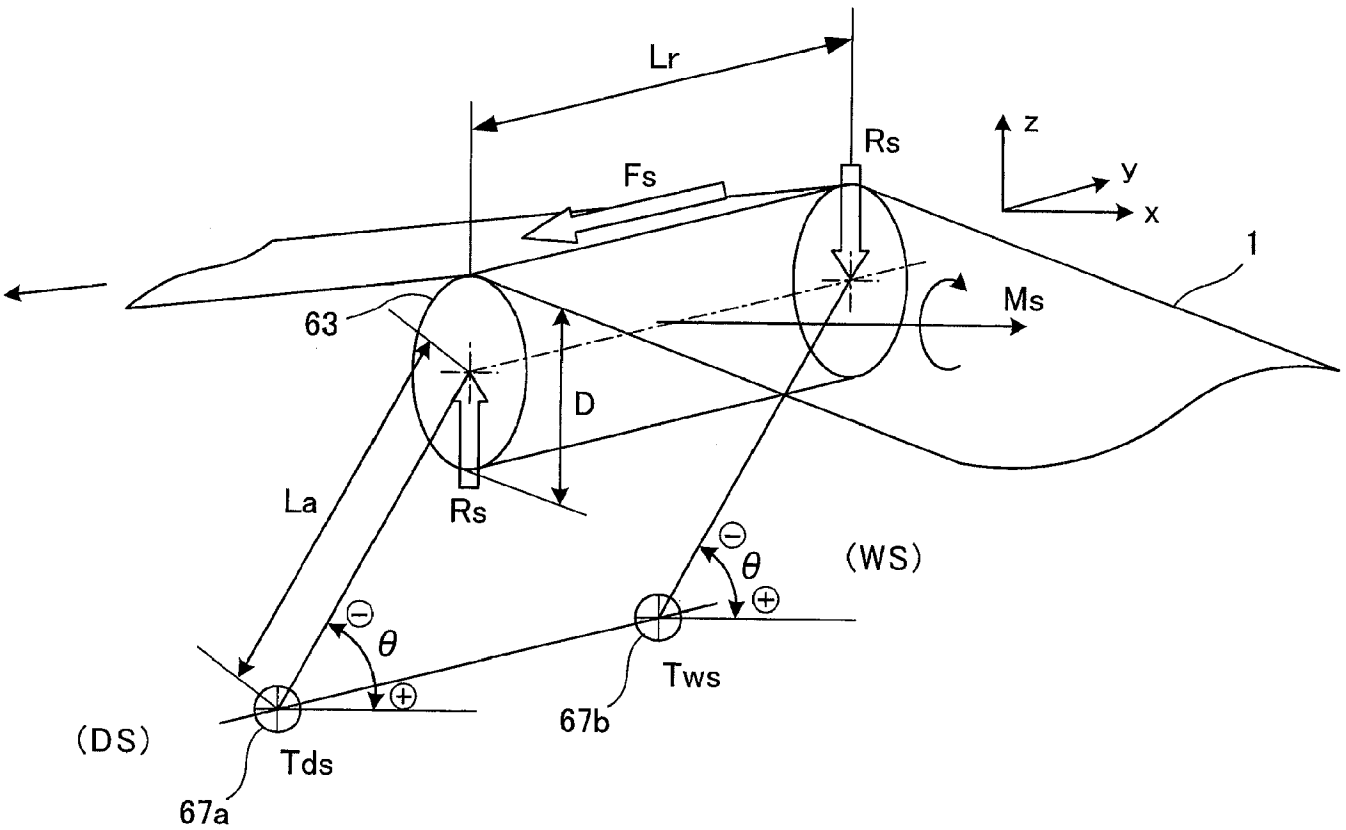

FIG. 5 is a view explaining how the torque difference between the left and right ends of the split roll is caused by meandering of the strip.

Figure 6:
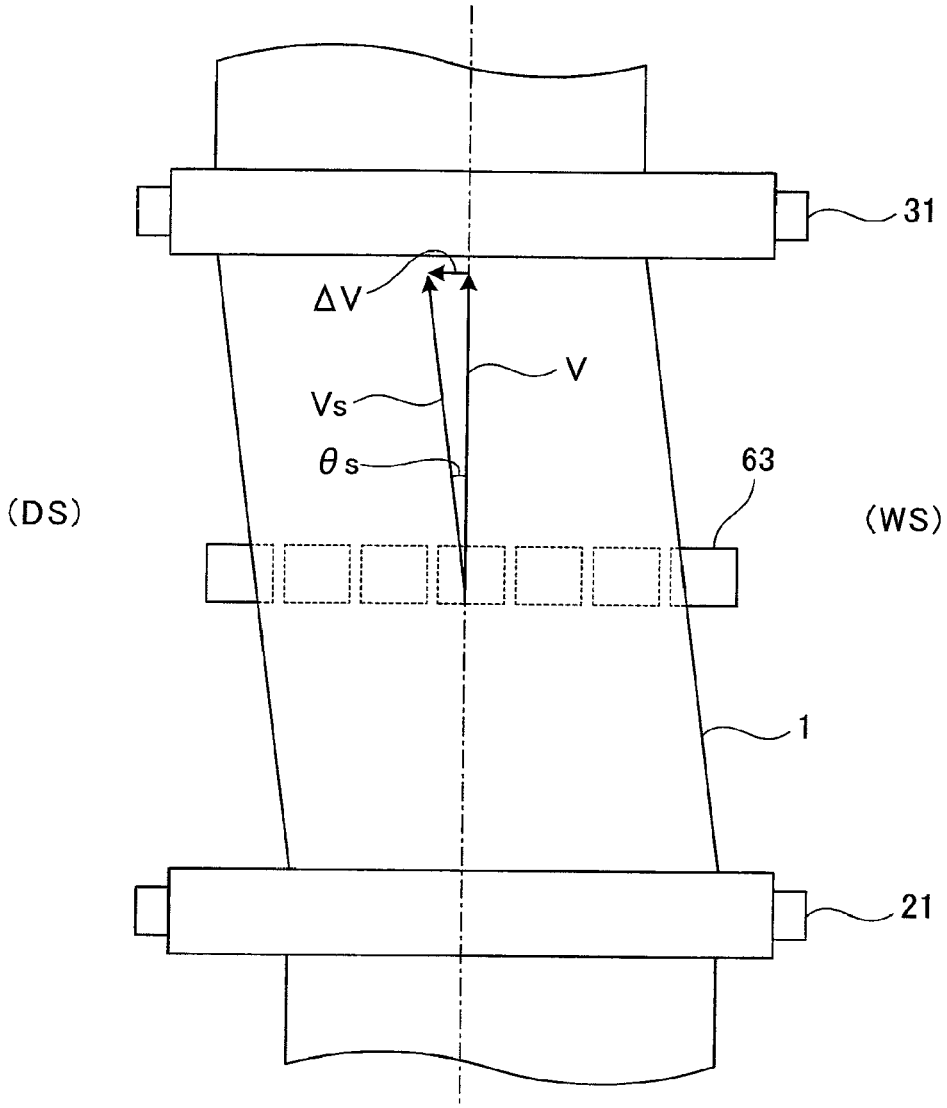

FIG. 6 is a view showing a meandering rolling state of the strip.

Figure 7:
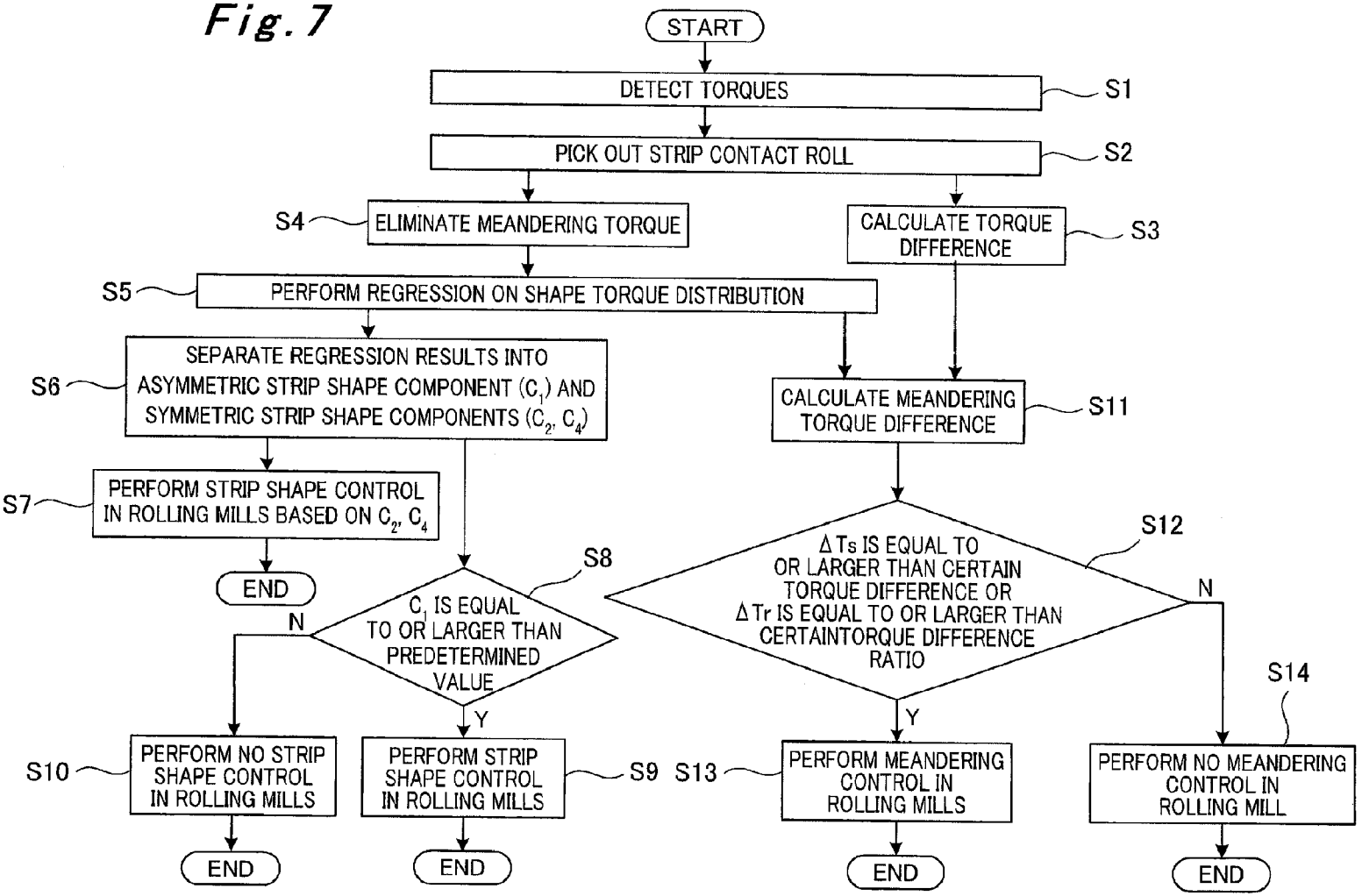

FIG. 7 is a flowchart of a hot rolling method according to the one embodiment of the present invention.

Figure 8:
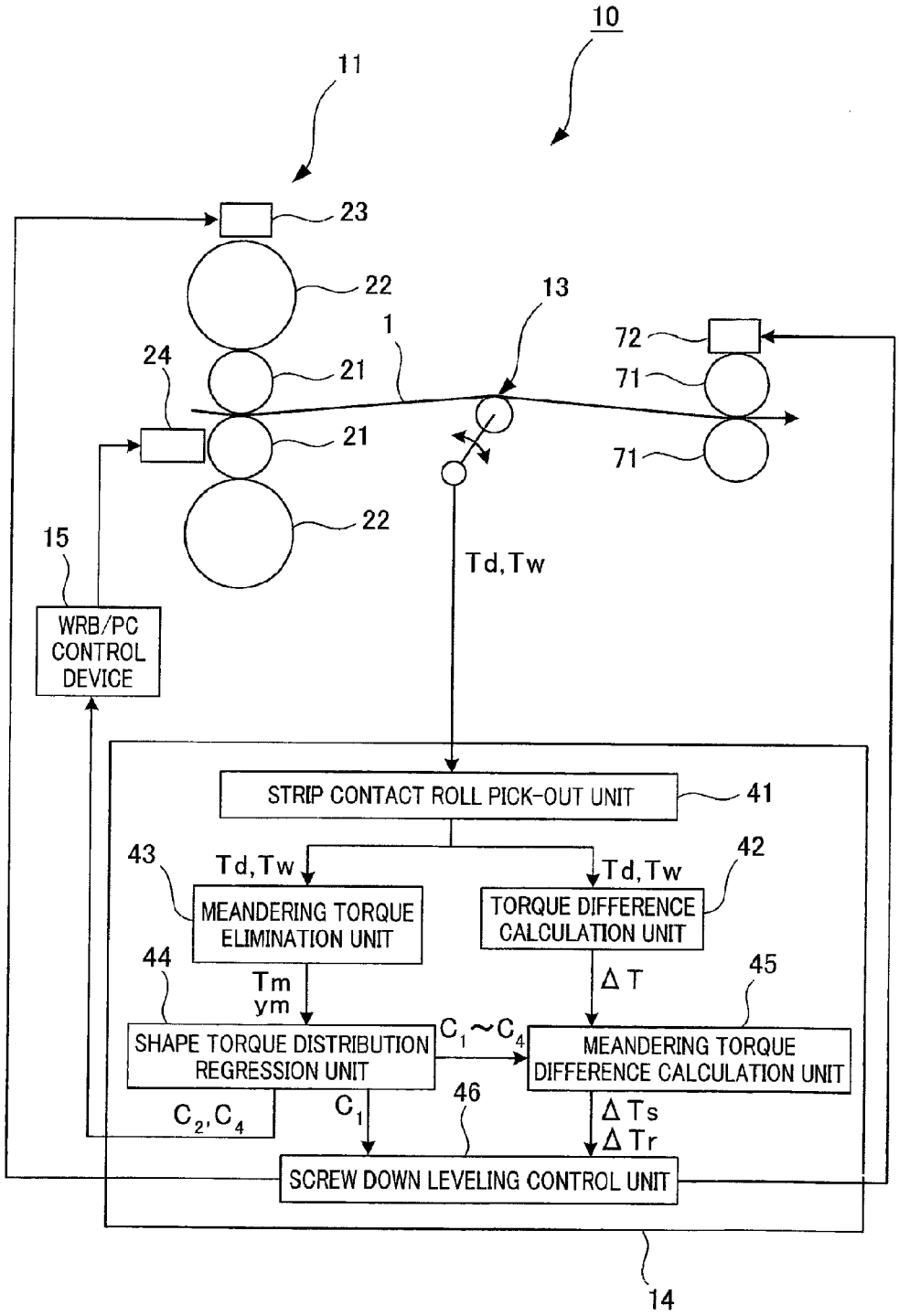

FIG. 8 is a schematic configuration diagram of a hot rolling line according to another embodiment of the present invention.

MODES FOR CARRYING OUT THE INVENTION

A hot rolling line and a hot rolling method according to the present invention are described below in detail by using the drawings.

Embodiment

Figure 1:
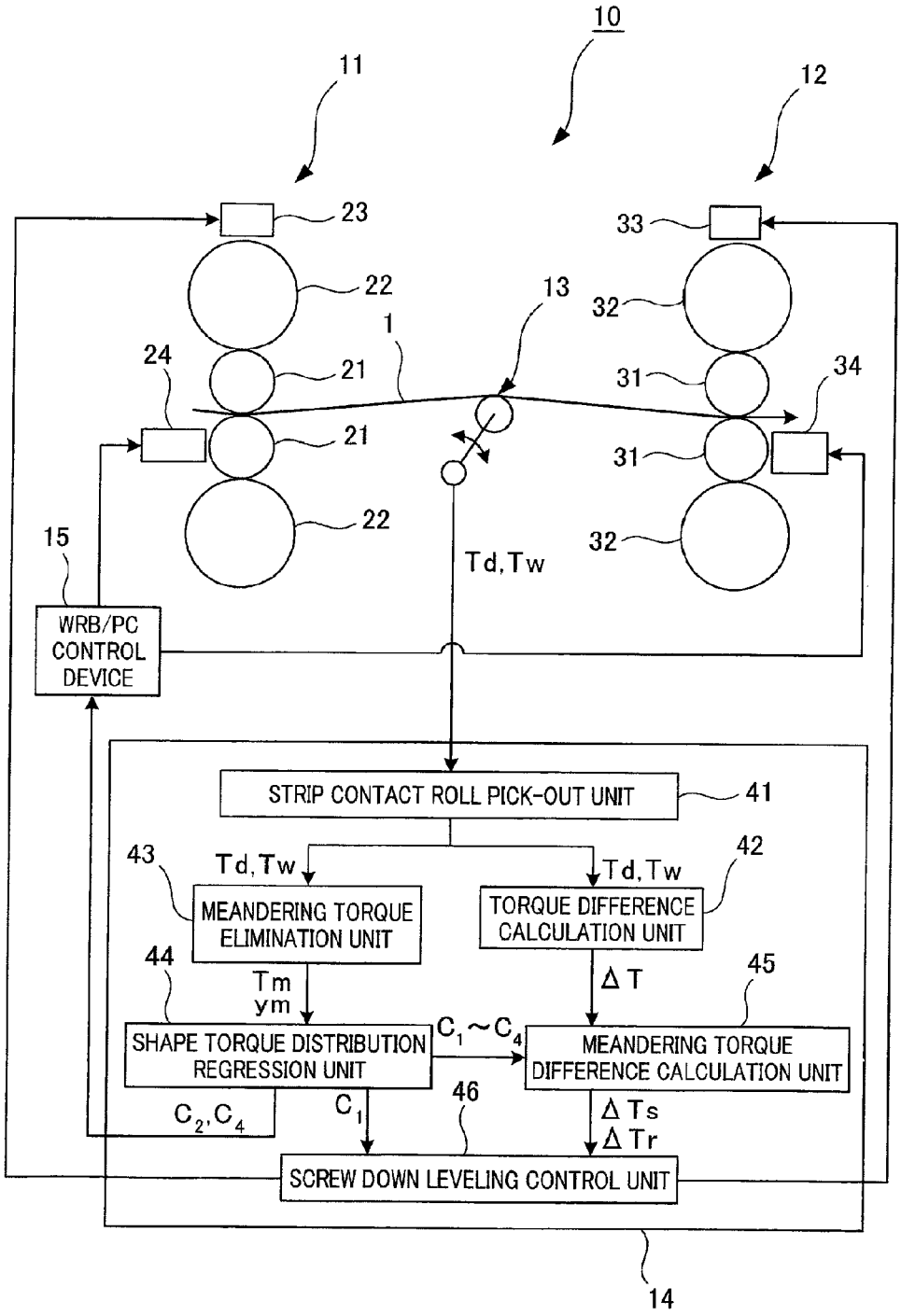
FIG. 1 is a schematic configuration diagram of a hot rolling line according to one embodiment of the present invention.

As shown in FIG. 1, a hot rolling line 10 has a tandem configuration in which multiple rolling mills are arranged in tandem in a rolling direction of a strip 1. In the hot rolling line 10, the strip 1 is sequentially threaded through the hot rolling mills and is thereby rolled to have a predetermined dimension (thickness and strip width), strip shape, and metal composition. Among the multiple rolling mills in the hot rolling line 10, FIG. 1 illustrates only two rolling mills 11, 12 which are adjacent to each other.

In the description below, the left side of the hot rolling line 10 in the rolling direction of the strip 1 is referred to as a drive side (DS) and the right side thereof is referred to as a work side (WS) as appropriate.

In the rolling mills 11, 12, pairs of upper and lower work rolls 21, 31 and pairs of upper and lower back-up rolls 22, 32 are rotatably supported. The work rolls 21, 31 are supported in contact with the back-up rolls 22, 32 from above and below, respectively.

Moreover, screw-down devices 23, 33 are provided above the upper back-up rolls 22, 32, respectively. The screw-down devices 23, 33 each include a pair of left and right hydraulic cylinders (not illustrated). The pair of left and right hydraulic cylinders are arranged to face left and right ends of each of the upper back-up rolls 22, 32 and can independently press the left and right ends of each of the back-up rolls 22, 32.

Accordingly, roll gaps between the work rolls 21, 31 can be changed through the upper back-up rolls 22, 32 by independently driving the hydraulic cylinders of the screw-down devices 23, 33 and adjusting screw-down leveling on the drive side and the work side of the rolling mills 11, 12. The strip 1 can be thus rolled to the predetermined thickness and strip shape.

Furthermore, WRB/PC devices 24, 34 are provided beside the work rolls 21, 31, respectively. The WRB/PC devices 24, 34 have a roll bending function or a roll crossing function.

In the case where the WRB/PC devices 24, 34 have the roll bending function, pairs of left and right roll bending hydraulic cylinders (not illustrated) are configured to be capable of pressing pairs of left and right bearings (not illustrated) rotatably supporting left and right ends of the work rolls 21, 31, respectively. Accordingly, the work rolls 21, 31 can be bent by driving the roll bending hydraulic cylinders and applying roll bending forces on the left and right ends of the work rolls 21, 31. The strip 1 can be thus rolled to the predetermined strip shape.

Meanwhile, in the case where the WRB/PC devices 24, 34 have the roll crossing function, pairs of left and right roll crossing hydraulic cylinders (not illustrated) are configured to be capable of pressing the pairs of left and right bearings (not illustrated) rotatably supporting the left and right ends of the work rolls 21, 31, respectively. Accordingly, the upper and lower work rolls 21, 31 can be set to a crossed state by driving the roll crossing hydraulic cylinders and turning the upper and lower work rolls 21, 31 in the opposite directions. The strip 1 can be thus rolled to the predetermined strip shape.

Moreover, a strip shape detection device 13 is provided between the rolling mills 11, 12. The strip shape detection device 13 is connected to a stable rolling control device 14, and the stable rolling control device 14 is connected to the screw-down devices 23, 33 and a WRB/PC control device 15. Furthermore, the WRB/PC control device 15 is connected to the WRB/PC devices 24, 34.

The stable rolling control device 14 includes a strip contact roll pick-out unit 41, a torque difference calculation unit 42, a meandering torque elimination unit 43, a shape torque distribution regression unit 44, a meandering torque difference calculation unit 45, and a screw-down leveling control unit 46.

The strip contact roll pick-out unit 41 to which the strip shape detection device 13 is connected is connected to the screw-down leveling control unit 46 via the torque difference calculation unit 42 and the meandering torque difference calculation unit 45, and is also connected to the screw-down leveling control unit 46 via the meandering torque elimination unit 43 and the shape torque distribution regression unit 44. Moreover, the shape torque distribution regression unit 44 is connected to the meandering torque difference calculation unit 45 and the WRB/PC control device 15, and the WRB/PC control device 15 is connected to the WRB/PC devices 24, 34. Furthermore, the screw-down leveling control unit 46 is connected to the screw-down devices 23, 33.

Next, the strip shape detection device 13 is described in detail by using parts (a) to (c) of FIG. 2 and FIG. 3.

As shown in parts (a) to (c) of FIG. 2, in the strip shape detection device 13, a pair of left and right supporting columns 51 are provided to stand and a bearing 52 is provided in an upper portion of each of the supporting columns 51. Moreover, a roll swinging motor 53 is provided on the drive side of the strip shape detection device 13, and a rotary shaft 54 is connected to a drive shaft 53*a* of the roll swinging motor 53. Furthermore, the rotary shaft 54 is rotatably supported by the bearings 52.

A supporting member 55 is provided on the rotary shaft 54 between the bearings 52, and multiple (seven in the drawing) guide plates 56 are supported on an upper surface of the supporting member 55. The guide plates 56 are arranged at predetermined intervals in a strip width direction of the strip 1 and are configured to guide the conveyed strip 1 by coming into contact with a lower surface of the strip 1. Furthermore, on a side surface of the supporting member 55 on a downstream side in the rolling direction of the strip 1, multiple (seven in the drawing) roll units 57 are provided to correspond to the guide plates 56.

As shown in FIG. 3, each of the roll units 57 includes a pair of left and right arm members 61*a*, 61*b*. A split roll (looper roll) 63 is supported between front ends of the arm members 61*a*, 61*b* via bearings 62*a*, 62*b* to be rotatable about a roll axis of the split roll 63. Specifically, the split rolls 63 are arranged in the strip width direction of the strip 1 and are capable of coming into contact (line contact) with the strip 1. Meanwhile, a supporting shaft 65 is supported between base ends of the arm members 61*a*, 61*b* via bearings 64*a*, 64*b*.

Moreover, a fixed member 66 is fixed to the supporting member 55. The supporting shaft 65 penetrates the fixed member 66 and is thus supported by the fixed member 66. A pair of left and right torque detectors 67*a*, 67*b* having ring shapes are provided on the supporting shaft 65 between the arm member 61*a* and the fixed member 66 and between the arm member 61*b* and the fixed member 66. The pair of left and right torque detectors 67*a*, 67*b* are configured to detect, via the arm members 61*a*, 61*b*, a detection torque Td on the drive side and a detection torque Tw on the work side which act on left and right ends of the split roll 63 when the strip 1 and the split roll 63 come into contact with each other. The torque detectors 67*a*, 67*b* are capable of outputting the detected detection torques Td, Tw to the strip contact roll pick-out unit 41.

With the above configuration, when the operation of the hot rolling line 10 is started and the strip 1 is conveyed to a position between the rolling mills 11, 12, the roll swinging motor 53 is activated to swing the split rolls 63 up and down. Accordingly, the split rolls 63 are always in contact with the lower surface of the strip 1 and rotate together with the strip 1 during the rolling. The split rolls 63 thus apply a certain amount of tensile force to the strip 1 being in contact therewith and provide an appropriate loop.

Furthermore, as described above, when the split rolls 63 come into contact with the strip 1, a load (torque) from the strip 1 acts on the split rolls 63. This load is transmitted from the left and right ends of each of the split rolls 63 to the torque detectors 67*a*, 67*b* via the arm members 61*a*, 61*b*, and is detected by the torque detectors 67*a*, 67*b* as the detection torques Td, Tw acting on the left and right ends of each of the split rolls 63.

In other words, the strip shape detection device 13 not only serves as a looper device by using the split rolls 63 but also detects the detection torques Td, Tw acting on the left and right ends of each of the split rolls 63 and outputs the detected detection torques Td, Tw to the stable rolling control device 14. The stable rolling control device 14 controls the screw-down leveling of the rolling mills 11, 12 on the basis of the inputted detection torques Td, Tw, as will be described later in detail. As a result, a stable rolling is achieved in the hot rolling line 10 as a whole.

Next, principles of a hot rolling method using the aforementioned strip shape detection device 13 are described, before giving detailed descriptions of the stable rolling control device 14 and the WRB/PC control device 15.

First, a basic operation in the hot rolling line 10 is the control of the screw-down leveling based on the difference between the detection torques Td, Tw acting on each of the split rolls 63. Thus, the principles of factors causing the torque difference between the detection torques Td, Tw are described by using FIGS. 4 to 6 schematically showing only one split roll 63.

FIGS. 4 and 5 show a state where the strip 1 is in full contact with the split roll 63 in a roll width direction. As is generally well known, tensile force distribution and strip shape distribution in the strip width direction of the strip are proportional to each other, and the strip shape is uniquely obtained when the tensile distribution is obtained. The description is given below based on this fact.

FIG. 4 schematically shows a state where tensile force distribution σ(y) in the strip width direction (y) of the strip 1 acts on the split roll 63. On a roll surface of the split roll 63 being in contact with the strip 1, line pressure distribution ps(y) in the vertical direction is generated by the tensile force distribution σ(y). In this case, the relationship between the tensile force distribution σ(y) and the line pressure distribution ps(y) can be expressed by the following formula (1).

[Math 1]

$$ps(y)=\sigma(y)t\ \mathrm{SIN}(\alpha)+\sigma(y)t\ \mathrm{SIN}(\beta) \tag{1}$$

Here, y represents a coordinate in the strip width direction of the strip 1 with a roll end (torque detector 67*a*) of the split roll 63 as an origin, t represents the strip thickness of the strip 1, and α, β each represent an angle (wound angle) formed between the strip 1 and a horizontal x-axis direction. It is found that the tensile force distribution σ(y) and the line pressure distribution ps(y) are proportional to each other.

Moreover, reaction forces Rd, Rw are generated at the left and right ends of the split roll 63 by the line pressure distribution ps(y). The reaction forces Rd, Rw can be expressed by the following formulae (2), (3), where Lr represents the roll width of the split roll 63 and Δg represents a gap between the split rolls 63 adjacent to each other.

[Math 2]

$$Rd+Rw=\int_{-\Delta g/2}^{Lr+\Delta g/2} ps(y)dy \tag{2}$$

$$RwLr=\int_{-\Delta g/2}^{Lr+\Delta g/2} ps(y)ydy \tag{3}$$

The reaction forces Rd, Rw are generated by reaction forces against forces acting on the arm members 61*a*, 61*b*. Accordingly, the detection torques Td, Tw detected by the torque detectors 67*a*, 67*b* can be expressed by the following formulae (4), (5), provided that a positive direction of a torque value is a direction in which the split roll 63 is displaced downward, i.e. a direction in which a looper angle θ becomes smaller and La represents the length of each of the arm members 61*a*, 61*b*.

[Math 3]

$$Td=La\ \mathrm{COS}(\theta)Rd \tag{4}$$

$$Tw=La\ \mathrm{COS}(\theta)Rw \tag{5}$$

Provided that ΔT represents the difference between the detection torques Td, Tw acting on the left and right ends of the split roll 63, the torque difference ΔT can be expressed by the following formula (6) from the formulae (4), (5).

[Math 4]

$$\Delta T=La\ \mathrm{COS}(\theta)(Rw-Rd) \tag{6}$$

Furthermore, it is found from the formulae (2) to (5) that the sum of the detection torques Td, Tw (Td+Tw) is proportional to a resultant force of the line pressure distribution ps(y) acting on the split roll 63.

Accordingly, it can be understood that the torque difference ΔT is generally caused by the tensile force distribution σ(y) acting on the strip 1 (shape of the strip 1). However, if ps(y)≈0 (constant) is satisfied in the formula (1), Rd≈Rw is obtained from the formulae (2), (3) and the torque difference ΔT is extremely small or equal to zero.

Moreover, it is apparent that the aforementioned torque difference ΔT caused by the shape of the strip 1 differs depending on the tensile force distribution σ(y), i.e. the shape of the strip 1.

Description has been given above of the reason why the torque difference between the left and right ends of the split roll 63 is caused by the shape of the strip 1. Description is given below of the reason why the torque difference between the left and right ends of the split roll 63 is caused by so-called meandering in which the strip 1 moves in a lateral direction.

FIG. 6 schematically shows a state (meandering rolling state) where the strip 1 is rolled between the work rolls 21, with an angle θs formed with respect to the rolling direction (line direction) parallel to the center line in the width direction of the hot rolling line 1 (rolling mills 11, 12).

In a steady rolling state in which the strip 1 is rolled by the work rolls 21, 31 on the front and back sides, the strip is held by the work rolls 21, 31. Hence the degree of meandering rarely suddenly becomes large and the rolling continues in a semi-stable state. On the other hand, in so-called tail-out being a state after a tail end of the strip 1 passes through a space between the work rolls 31 on the rear side, the tensile force is released and the tail end of the strip 1 is thereby suddenly shifted in the strip width direction thereof. This causes tail pinching in the work rolls 21 on the front side.

In the meandering rolling state described above, the strip 1 is rolled at a speed Vs in the angle θs direction. Accordingly, the speed Vs can be divided into a rolling speed component V in the rolling direction and a meandering speed component ΔV in a direction (lateral shift direction) perpendicular to the rolling direction. The meandering speed component ΔV can be expressed by the following formula (7).

[Math 5]

$$\Delta V=Vs\ \mathrm{SIN}(\theta s) \tag{7}$$

In other words, the strip 1 in contact with the split roll 63 is conveyed while sliding on the roll surface of the split roll 63 at the meandering speed component ΔV.

The values (detection torques) detected by the torque detectors 67*a*, 67*b* disposed at the left and right ends of the split roll 63 in the meandering rolling state described above are described by using FIG. 5. Like FIG. 4, FIG. 5 schematically shows one split roll 63. Moreover, the tensile force distribution σ(y) acting on the split roll 63 shown in FIG. 5 is the same as that in FIG. 4 and the line pressure distribution ps(y) in the vertical direction generated by the tensile force distribution σ(y) is expressed by the formula (1) shown above. In FIG. 5, the illustration of the tensile force distribution σ(y) and the line pressure distribution ps(y) is omitted.

When the strip 1 having the line pressure distribution ps(y) described above slides on the roll surface of the split roll 63 at the meandering speed component ΔV, a force Fs acts in a roll axis direction of the split roll 63. The force Fs can be expressed by the following formula (8), where μ represents a coefficient of friction between the strip 1 and the split roll 63 against sliding in the roll axis direction. The coefficient of friction μ has such a characteristic that the coefficient of friction μ becomes smaller as the sliding of the strip 1 becomes smaller (as the angle θs becomes smaller).

[Math 6]

$$Fs=\mu\int_{-\Delta g/2}^{Lr+\Delta g/2} ps(y)dy \tag{8}$$

Moreover, since the force Fs acts in the roll axis direction of the split roll 63, an overturning moment Ms acts on the split roll 63. The overturning moment Ms can be expressed by the following formula (9), where D represents the diameter of the split roll 63.

[Math 7]

$$Ms = Fs\frac{D}{2} \tag{9}$$

Moreover, the overturning moment Ms generates a couple RS at the left and right ends of the split roll 63, the couple RS including forces which are parallel to each other, equal in magnitude, and opposite in the direction of action. The couple RS can be expressed by the following formula (10).

[Math 8]

$$Rs = \frac{Fs}{2}\frac{D}{Lr} = \frac{Ms}{Lr} \tag{10}$$

In other words, the detection values of the torque detectors 67*a*, 67*b* are outputted while the torques Tds, Tws which are equal in magnitude and opposite in the direction of action are added respectively to these detection values. The torques Tds, Tws can be expressed by the following formulae (11), (12).

[Math 9]

$$Tds=La\ \mathrm{COS}(\theta)Rs \tag{11}$$

$$Tws=-La\ \mathrm{COS}(\theta)Rs \tag{12}$$

The torque difference ΔTs between the left and right ends of the split roll 63 can be thus expressed by the following formula (13).

[Math 10]

$$\Delta Ts=Tws-Tds=-2La\ \mathrm{COS}(\theta)Rs \tag{13}$$

In the following description, the aforementioned torques Tds, Tws generated by the meandering of the strip 1 are referred to as meandering torques Tds, Tws. Moreover, the torque difference ΔTs which is the difference between these torques are referred to as meandering torque difference ΔTs.

Next, description is given of a method of eliminating the meandering torques Tds, Tws from the detection torques Td, Tw detected by the torque detectors 67*a*, 67*b* and thus separating shape torques generated respectively at the left and right ends of split roll 63 by the shape of the strip 1.

Specifically, the meandering torques Tds, Tws can be eliminated by averaging the detection torque Td and the detection torque Tw. As is apparent from the formulae (11), (12), and (13) shown above, this elimination utilizes the fact that the meandering torque difference ΔTs between the left and right ends of the split roll 63 is proportional to the sum of the meandering torques Tds, Tws and the fact that the meandering torques Tds, Tws are equal in magnitude and opposite in the direction of action. Accordingly, an average value obtained by averaging the detection torques Td, Tw can be used to eliminate or minimize the effect of the meandering torques Tds, Tws.

In the description, the multiple split rolls 63 are numbered from first to n-th and i represents the number of the split roll 63 selected arbitrarily from the first to n-th split rolls 63.

Provided that $Td_i$, $Tw_i$ represent the detection torques detected at the left and right ends of the i-th split roll 63, a both-end averaged torque (shape torques, torque average value) $Tm_i$ obtained by averaging the detection torques $Td_i$, $Tw_i$ is expressed as $(Td_i+Tw_i)/2$. Then the both-end averaged torque $Tm_i$ is set as a detection torque representing the i-th split roll 63. Furthermore, provided that $yd_i$, $yw_i$ represent the coordinates of the torque detectors 67*a*, 67*b* of the i-th split roll 63 in a y-axis direction, a both-end averaged coordinate (coordinate average value) $ym_i$ obtained by averaging the coordinates $yd_i$, $yw_i$ is expressed as $(yd_i+yw_i)/2$. In other words, the both-end averaged torque $Tm_i$ can be considered as a detection value at the both-end averaged coordinate $ym_i$.

Accordingly, obtaining the both-end averaged torque $Tm_i$ and the both-end averaged coordinate $ym_i$ by using the averaging process described above means that the meandering torques $Tds_i$, $Tws_i$ are eliminated from the detection torques $Td_i$, $Tw_i$.

Moreover, during the rolling, the number of the split rolls 63 being in full contact with the strip 1 over the entire roll width is larger than the number of the split rolls 63 being in partial contact with the strip 1. Accordingly, when the averaging process for each split roll 63 is performed, the reliability of the calculation result is improved by excluding the split rolls 63 being in partial contact with the strip 1. Hence, in regression of the both-end averaged torque $Tm_i$ and the both-end averaged coordinate $ym_i$ to be described later, only the split rolls 63 being in full contact with the strip 1 over the entire roll width are used.

However, when the number of the split rolls 63 is small and the number of the both-end averaged torques $Tm_i$ is insufficient to perform regression, the both-end averaged torques $Tm_i$ of the split rolls 63 being in partial contact with the strip 1 may be used.

After the averaging process is completed, regression is performed on the both-end averaged torque $Tm_i$ and the both-end averaged coordinate $ym_i$ by using a regression model formula having a predetermined degree. Hence, the regression result of this regression is obtained through regression using only the shape torques. The regression result is thus not affected by the meandering torques $Tds_i$, $Tws_i$ and includes only the characteristic of the shape component of the strip 1.

A regression model formula T(y) for performing regression on the both-end averaged torque $Tm_i$ and the both-end averaged coordinate $ym_i$ can be expressed by the following formula (14), where s represents an offset amount (hereafter, referred to as a meandering amount) of the strip-width-direction center line of the strip 1 from the width-direction center line of the hot rolling line 1 (rolling mills 11, 12) to the outer side in the width-direction. $C_0$ to $C_4$ represent regression model coefficients.

[Math 11]

$$T(y)=C_0+C_1(y-s)+C_2(y-s)^2+C_3(y-s)^3+C_4(y-s)^4 \quad (14)$$

Here, the regression model coefficients $C_0$ to $C_4$ are determined through a least squares method by using the both-end averaged torque $Tm_i$ and the both-end averaged coordinate $ym_i$. Specifically, in the case where an evaluation function J representing the least squares method is expressed by using the formula (14), the evaluation function J can be expressed as shown in the following formula (15).

[Math 12]

$$J=\sum_{i=1}^{n}(T(ym_i)-Tm_i)^2=\sum_{i=1}^{n}\{C_0+C_1(ym_i-s)+C_2(ym_i-s)^2+C_3(ym_i-s)^3+C_4(ym_i-s)^4-Tm_i\}^2\text{:MIN.} \quad (15)$$

Since the method of obtaining the regression model coefficients $C_0$ to $C_4$ from the formula (15) shown above is well known, the detailed description thereof is omitted herein. Here, the meandering amount s is required to obtain the regression model coefficients $C_0$ to $C_4$ by using the formula (15), and assumption of the meandering amount s is performed several times to calculate the evaluation function J. The regression result of the regression model formula T(y) using the meandering amount s at which the evaluation function J is the smallest is closest to the shape torque distribution.

The method of performing regression on the both-end averaged torque $Tm_i$ and the both-end averaged coordinate $ym_i$ has been described above. In the method, since the both-end averaged torque $Tm_i$ and the both-end averaged coordinate $ym_i$ are used, the effect of the meandering torques $Tds_i$, $Tws_i$ can be eliminated from the regression result.

Next, description is given of a method of extracting the meandering torque difference ΔTs from the torque difference ΔT and correcting the meandering torque difference ΔTs by using the regression result described above.

Provided that $Td_i$, $Tw_i$ represent the detection torques detected at the left and right ends of the i-th split roll 63, the torque difference $\Delta T_i$ can be expressed by the following formula (16).

[Math 13]

$$\Delta T_i=Tw_i-Td_i \quad (16)$$

The torque difference $\Delta T_i$ calculated from the formula (16) shown above includes the shape torque difference caused by the shape of the strip 1. Accordingly, the meandering of the strip 1 can be accurately controlled by eliminating the shape torque difference from the torque difference $\Delta T_i$ to extract the meandering torque difference $\Delta Ts_i$ and by using the thus-extracted meandering torque difference $\Delta Ts_i$.

In other words, the meandering torque difference $\Delta Ts_i$ can be extracted from the torque difference $\Delta T_i$ by using the formula (16) and the regression model formula T(y) for performing regression on the both-end averaged torque $Tm_i$ and the both-end averaged coordinate $ym_i$. The meandering torque difference $\Delta Ts_i$ can be expressed by the following formula (17). Here, the second term on the right-hand side of the formula (17) is a correction term of the shape torque difference.

[Math 14]

$$\Delta Ts_i=\Delta T_i-[T(yw_i)-T(yd_i)] \quad (17)$$

Moreover, in practice, it is preferable to obtain the meandering torque differences $\Delta Ts_i$ of the multiple split rolls 63 and use the average of the meandering torque differences $\Delta Ts_i$. For example, the split roll 63 which corresponds to the strip-width-direction center portion of the strip 1 and the adjacent split rolls 63 which are at both sides in the roll axis direction of the split roll 63 located at the strip-width-direction center portion thereof are selected, and the meandering torque differences $\Delta Ts_i$ of these three split rolls 63 are averaged. The meandering torque difference $\Delta Ts_i$ which has statistically less variation and is more stable can be thereby obtained. The meandering of the strip 1 can be thus accurately controlled.

Next, description is given of an effect of the looper angle θ on the meandering torque difference ΔTs and a method of eliminating the effect.

As is apparent from the formula (13) shown above, the meandering torque difference ΔTs is dependent on the looper angle θ. This means that the value of the meandering torque difference ΔTs differs depending on the looper angle θ even when physical causes of the meandering are the same. Accordingly, when the screw-down leveling is controlled based on a meandering control amount proportional to the meandering torque difference ΔTs, the degree of the control may be too large or too small depending on the looper angle θ. This becomes a problem particularly when rolling is performed under a state where a looper angle θ varies largely.

Correcting the meandering torque difference ΔTs in accordance with the looper angle θ is conceivable as a method of solving such a problem. For example, the looper angle to be a reference is defined as $\theta_0$ (for example, 20°) and the current looper angle is defined as θ. Moreover, the meandering torque difference calculated by using the looper angle θ is defined as ΔTθ, and the meandering torque difference in the case where the looper angle θ is assumed to be the reference angle $\theta_0$ is defined as $\Delta T\theta_0$. In this case, $\Delta T\theta_0=\Delta T\theta\times COS(\theta_0)/(COS\ \theta)$ is satisfied and the meandering torque difference ΔTθ can be corrected in accordance with the looper angle θ.

The screw-down leveling control is performed based on the corrected meandering torque difference $\Delta T\theta_0$. The screw-down leveling can be thereby controlled with the effect of the looper angle θ eliminated from the meandering torque difference ΔTθ, and the accurate meandering control can be easily performed. Furthermore, in the case where the meandering torque difference is displayed on a monitoring screen, monitoring of the meandering of the strip 1 is facilitated by displaying the corrected meandering torque difference $\Delta T\theta_0$ which is not affected by the looper angle θ.

There is another method of eliminating the effect of the looper angle θ from the meandering torque difference ΔTs. For example, the following formula (18) can be obtained to achieve a ratio between the both-end averaged torque $Tm_i$ and the meandering torque difference $\Delta Ts_i$ when the average of the detection torques $Td_i$, $Tw_i$ detected at the left and right ends of the i-th split roll 63 is defined as the both-end averaged torque $Tm_i$.

[Math 15]

$$\Delta Tr_i=\frac{\Delta Ts_i}{Tm_i} \quad (18)$$

$\Delta Tr_i$ obtained from the formula (18) shown above is referred to as meandering torque difference ratio. The denominator and numerator of the meandering torque difference ratio $\Delta Tr_i$ are detection torques multiplied by a factor of the looper angle θ. Accordingly, obtaining the ratio between the both-end averaged torque $Tm_i$ and the meandering torque difference $\Delta Ts_i$ eliminates the effect of the looper angle θ from the meandering torque difference ratio $\Delta Tr_i$.

In this case, for example, the both-end averaged torque $Tm_i$ of the split roll 63 which corresponds to the strip-width-direction center portion of the strip 1 and the both-end averaged torques $Tm_i$ of the adjacent split rolls 63 which are at both sides in the roll axis direction of the split roll 63 located at the strip-width-direction center portion are used as the both-end averaged torque Tmi. Alternatively, the detection torques $Td_i$, $Tw_i$ of each of the split rolls 63 being in full contact with the strip 1 over the entire roll width may be averaged.

Next, description is given of an effect of the tensile force of the strip 1, which acts between the rolling mills 11, 12, on the meandering torque difference ΔTs and a method of eliminating the effect.

The meandering torque difference ΔTs is proportional to the tensile force of the strip 1 acting between rolling mills 11, 12. This can be well understood from the fact that the line pressure distribution ps(y) acting on the split roll 63 is proportional to the tensile force of the strip 1, which is apparent from the formula (1) shown above. Moreover, as described above, the line pressure distribution ps(y) generates the overturning moment Ms through the coefficient of friction μ, and the couple Rs generated by the overturning moment Ms is detected as the meandering torque difference ΔTs between the left and right ends of the split roll 63. Accordingly, it can be well understood also from this fact that the meandering torque difference $\Delta Ts_i$ is dependent on the tensile force of the strip 1 acting between the rolling mills 11, 12. Similarly, it is apparent that the both-end averaged torque $Tm_i$ is also dependent on the tensile force.

Accordingly, the meandering torque difference ratio $\Delta Tr_i$ which is independent from the tensile force of the strip 1 acting between the rolling mills 11, 12 can be achieved by obtaining the ratio between the both-end averaged torque $Tm_i$ and the meandering torque difference $\Delta Ts_i$ as shown in the formula (18) described above. In practice, the meandering torque difference ratios $\Delta Tr_i$ of the multiple split rolls 63 are averaged. The meandering torque difference ratio $\Delta Tr_i$ which has statistically less variation and is more stable can be thereby obtained.

The meandering control which is not affected by the looper angle θ and the tensile force of the strip 1 can be thus easily performed with the meandering torque difference ratio $\Delta Tr_i$. Moreover, in the case where the meandering torque difference ratio $\Delta Tr_i$ is displayed on the monitoring screen, monitoring of the meandering of the strip 1 is facilitated.

The principles of the hot rolling method using the strip shape detection device 13 have been described so far. On the basis of this description, the stable rolling control device 14 and the WRB/PC control device 15 are specifically described below by using FIG. 1.

First, the strip contact roll pick-out unit 41 picks out the split rolls 63 being in contact with the strip 1, on the basis of the detection torques Td, Tw in each of the split rolls 63 inputted from the strip shape detection device 13. Furthermore, the strip contact roll pick-out unit 41 determines whether each of the picked-out split rolls 63 is in full contact with the strip 1 over the entire roll width and outputs the detection torques Td, Tw in the picked-out split rolls 63.

Here, the detection torques Td, Tw of the split roll 63 not being in contact with the strip 1 are zero. Accordingly, the split rolls 63 being in contact with the strip 1 can be picked out by identifying the split rolls 63 having the detection torques Td, Tw of zero.

Specifically, when the non-contact split roll 63 not being in contact with the strip 1 is identified, the adjacent split roll 63 at an inner side of the non-contact split roll 63 in the strip width direction can be determined as a partial-contact split roll 63 being in contact with a strip end portion of the strip 1. Furthermore, the split rolls 63 other than the partial-contact split roll 63 can be determined as full-contact split rolls 63 being in full contact with the strip 1 over the entire roll width. In this way, it is possible to determine whether each of the picked-out split rolls 63 is the full-contact split roll 63 or not.

Moreover, the strip contact roll pick-out unit 41 can select the full-contact split rolls 63, or, the full-contact and partial-contact split roll 63. The detection torques Td, Tw of the selected split rolls 63 are outputted to the torque difference calculation unit 42 and the meandering torque elimination unit 43.

The torque difference calculation unit 42 calculates, from the detection torques Td, Tw of the full-contact split rolls 63 or from the detection torques Td, Tw of the full-contact and partial-contact split rolls 63, the torque differences ΔT in the respective selected split rolls 63. In this case, each of the torque differences ΔT is calculated by using the formula (16) and is outputted to the meandering torque difference calculation unit 45.

The meandering torque elimination unit 43 eliminates the meandering torques Tds, Tws from the detection torques Td, Tw of the full-contact split rolls 63 or from the detection torques Td, Tw of the full-contact and partial-contact split rolls 63. In this event, the averaging process described above is performed as a method of eliminating the meandering torques Tds, Tws from the detection torques Td, Tw.

In the averaging process, the meandering torques Tds, Tws can be separated from the detection torques Td, Tw by obtaining the both-end averaged torque Tm and the both-end averaged coordinate ym, and the obtained both-end averaged torque Tm includes only the shape torques as a component. The both-end averaged torque Tm with the meandering torques Tds, Tws eliminated and the both-end averaged coordinate ym corresponding to this both-end averaged torque Tm are outputted to the shape torque distribution regression unit 44.

The detection positions of the detection torques Td, Tw are expressed by coordinates (y coordinates) whose origin is at the width-direction center line of the hot rolling line 1 (hot rolling mills 12, 13). Moreover, the strip shape detection device 13 is installed in such a way that the width-direction center line thereof coincides with the width-direction center line of the hot rolling line 1. Accordingly, the averaging process can be simplified by expressing the coordinates of the torque detectors 67*a*, 67*b* at the left and right ends of each split roll 63 by coordinates whose origin is on the width-direction center line of the hot rolling line 1.

The shape torque distribution regression unit 44 performs regression on the both-end averaged torque Tm with the meandering torques Tds, Tws eliminated and on the both-end averaged coordinate ym corresponding to this both-end averaged torque Tm, by using the regression model formula T(y) having a predetermined degree. The regression model coefficients $C_0$ to $C_4$ indicating the shape components of the strip 1 in the strip width direction are thereby obtained as a regression result.

Then, the regression model coefficients $C_1$ to $C_4$ are outputted to the meandering torque difference calculation unit 45. Moreover, the regression model coefficient $C_1$ which is an asymmetric strip shape component (coefficient of an odd degree) is outputted to the screw-down leveling control unit 46 while the regression model coefficients $C_2$, $C_4$ which are symmetric strip shape components (coefficients of an even degree) are outputted to the WRB/PC control device 15.

The meandering torque difference calculation unit 45 extracts the meandering torque difference ΔTs by performing correction calculation of the torque difference ΔT on the basis of the regression model coefficients $C_1$ to $C_4$.

Specifically, as shown in the formula (17), the meandering torque difference ΔTs in each of the split rolls 63 is calculated by using the regression model formula T(y) and, thereafter, the calculated meandering torque differences ΔTs are averaged. Then, the averaged meandering torque difference ΔTs is outputted to the screw-down leveling control unit 46.

In the above description, the output value of the meandering torque difference calculation unit 45 is the meandering torque difference ΔTs. However, the output value may be the meandering torque difference ratio ΔTr. As shown in the formula (18), the meandering torque difference ratio ΔTr can be obtained from the ratio between the both-end averaged torque Tm and the meandering torque difference ΔTs.

The screw-down leveling control unit 46 calculates the meandering control amount (screw-down leveling control amount) related to the meandering control, on the basis of the meandering torque difference ΔTs or the meandering torque difference ratio ΔTr, and outputs the calculated meandering control amount to the screw-down devices 23, 33. In addition, the screw-down leveling control unit 46 calculates an asymmetric strip shape control amount (screw-down leveling control amount) related to the control of an asymmetric strip shape, on the basis of the regression model number $C_1$ being the asymmetric strip shape component, and outputs the calculated asymmetric strip shape control amount to the screw-down devices 23, 33. As a result, at least one of the meandering control and the shape control of the strip 1 is performed in the rolling mills 11, 12.

The screw-down leveling control unit 46 determines whether the meandering torque difference ΔTs is equal to or larger than a certain torque difference set in advance or determines whether the meandering torque difference ratio ΔTr is equal to or larger than a certain torque difference ratio set in advance. When the meandering torque difference ΔTs is equal to or larger than the certain torque difference or when the meandering torque difference ratio ΔTr is equal to or larger than the certain torque difference ratio, the screw-down leveling control unit 46 performs the meandering control of the strip 1 in the hot rolling mills 11, 2 through the screw-down devices 23, 33. On the other hand, when the meandering torque difference ΔTs is smaller than the certain torque difference or when the meandering torque difference ratio ΔTr is smaller than the certain torque difference ratio, the screw-down leveling control unit 46 does not perform the meandering control of the strip 1 in the hot rolling mills 11, 2 through the screw-down devices 23, 33. Here, the certain torque difference which is a threshold of the meandering torque difference ΔTs or the certain torque difference ratio which is a threshold of the meandering torque difference ratio ΔTr is set based on rolling conditions such as the type, strip thickness, strip width, and rolling speed of the strip 1.

Moreover, the screw-down leveling control unit 46 determines whether the regression model number $C_1$ is equal to or larger than a certain value set in advance. When the regression model number $C_1$ is equal to or larger than the certain value, the screw-down leveling control unit 46 performs the asymmetric strip shape control of the strip 1 in the rolling mills 11, 12 through the screw-down devices 23, 33. On the other hand, when the regression model number $C_1$ is smaller than the certain value, the screw-down leveling control unit 46 does not perform the asymmetric strip shape control of the strip 1 in the rolling mills 11, 12 through the screw-down devices 23, 33. Here, the certain value which is a threshold of the regression model number $C_1$ is set based on rolling conditions such as the type, strip thickness, strip width, and rolling speed of the strip 1.

The WRB/PC control device 15 calculates a symmetric strip shape control amount related to the symmetric strip shape control, on the basis of the regression model coefficients $C_2$, $C_4$ being the symmetric strip shape component, and outputs the calculated symmetric strip shape control amount to the WRC/PC devices 24, 34. The shape control of the strip 1 is thereby performed in the rolling mills 11, 12.

Next, procedures of the hot rolling method are described in detail by using FIG. 7.

First, in step S1, the torque detectors 67*a*, 67*b* detect the detection torques Td, Tw.

Next, in step S2, the strip contact roll pick-out unit 41 picks out the split rolls 63 in contact with the strip 1 and, thereafter, stores the detection torques Td, Tw of each of the picked-out split rolls 63.

Subsequently, in step S3, the torque difference calculation unit 42 calculates the torque difference ΔT.

Then, in step S4, the meandering torque elimination unit 43 performs the averaging process of the detection torques Td, Tw to calculate the both-end averaged torque Tm and the both-end averaged coordinate ym. The meandering torques Tds, Tws are thereby eliminated from the detection torques Td, Tw.

Next, in step S5, the shape torque distribution regression unit 44 performs regression on the both-end averaged torque Tm and the both-end averaged coordinate ym by using the regression model formula T(y) and obtains the regression model coefficients $C_0$ to $C_4$ as regression results.

Subsequently, in step S6, the shape torque distribution regression unit 44 separates the regression model coefficients $C_0$ to $C_4$ into the regression model coefficient $C_1$ being the asymmetric strip shape component and the regression model coefficients $C_2$, $C_4$ being the symmetric strip shape components.

Next, in step S7, the WRC/PC control device 15 controls the WRC/PC devices 24, 34 on the basis of the regression model coefficients $C_2$, $C_4$. The rolling mills 11, 12 thus perform the symmetric strip shape control of the strip 1.

Then, in step S8, the screw-down leveling control unit 46 determines whether the regression model coefficient $C_1$ is equal to or larger than the certain value. When it is yes in step S8, the screw-down leveling control unit 46 controls, in step S9, the screw-down devices 23, 33 in such a way as to perform the asymmetric strip shape control of the strip 1 in the rolling mills 11, 12. On the other hand, when it is no, the screw-down leveling control unit 46 controls, in step S10, the screw-down devices 23, 33 in such a way as not to perform the asymmetric strip shape control of the strip 1 in the rolling mills 11, 12.

Meanwhile, in step S11, the meandering torque difference calculation unit 45 corrects the torque difference ΔT by using the regression model coefficients $C_1$ to $C_4$ and calculates the meandering torque difference ΔTs. When it is necessary to obtain an accurate calculation result by eliminating the effects of the looper angle θ and the tensile force of the strip 1, the meandering torque difference ratio ΔTr is calculated from the ratio between the both-end averaged torque Tm and the meandering torque difference ΔTs.

Next, in step S12, the screw-down leveling control unit 46 determines whether the meandering torque difference ΔTs is equal to or larger than the certain torque difference or determines whether the meandering torque difference ratio ΔTr is equal to or larger than the certain torque difference ratio. When it is yes in step S12, the screw-down leveling control unit 46 controls, in step S13, the screw-down devices 23, 33 in such a way as to perform the meandering control of the strip 1 in the rolling mills 11, 12. On the other hand, when it is no, the screw-down leveling control unit 46 controls, in step S14, the screw-down devices 23, 33 in such a way as not to perform the meandering control of the strip 1 in the rolling mills 11, 12.

In the embodiment described above, the strip shape detection device 13 is provided between the predetermined rolling mills 11, 12. However, as shown in FIG. 8, the strip shape detection device 13 may be provided between the rolling mill 11 at a last stage and a pair of upper and lower pinch rolls 71 disposed at a delivery side of the rolling mill 11.

The pinch rolls 71 are rotatably supported and hold the conveyed strip 1 therebetween from above and below to guide the strip 1 with the tensile force of the strip 1 maintained. In addition, a screw-down device 72 is provided above the upper pinch roll 71. The screw-down device 72 has a configuration similar to those of the screw-down devices 23, 33 and can independently press left and right ends of the upper pinch roll 71. Moreover, the screw-down leveling control unit 46 is connected to the screw-down device 72.

Specifically, the screw-down leveling control unit 46 calculates the meandering control amount (screw-down leveling control amount) related to the meandering control, on the basis of the meandering torque difference ΔTs or the meandering torque difference ratio ΔTr, and outputs the calculated meandering control amount to the screw-down devices 23, 72. In addition, the screw-down leveling control unit 46 calculates the asymmetric strip shape control amount (screw-down leveling control amount) related to the asymmetric strip shape control, on the basis of the regression model number $C_1$ of the asymmetric strip shape component, and outputs the calculated asymmetric strip shape control amount to the screw-down devices 23, 72. As a result, at least one of the meandering control and the shape control of the strip 1 is performed in the rolling mill 11 and the pair of upper and lower pinch rolls 71.

In the hot rolling line and the hot rolling method of the present invention, when the split rolls 63 are in contact with the strip 1, the detection torques Td, Tw acting on the left and right ends of each split roll 63 are detected by the torque detectors 67*a*, 67*b*, and the meandering and the shape of the strip 1 are controlled by adjusting the screw-down leveling of the rolling mills 11, 12 on the basis of the detected detection torques Td, Tw. This enables accurate control of the meandering and the shape of the strip 1. Accordingly, the tail pinching of the strip 1 can be prevented.

Moreover, each split roll 63 is rotatably supported between the front ends of the long arm members 61*a*, 61*b*. The detection torques Td, Tw can be thereby detected in an amplified state by the torque detectors 67*a*, 67 provided at the base ends of the arm members 61*a*, 61*b*. Accordingly, the meandering and the shape of the strip 1 can be accurately controlled even when the magnitudes of the detection torques Td, Tw are small.

Furthermore, since the detection values of the torque detectors 67*a*, 67 include only the detection torques Td, Tw, the torque detectors 67*a*, 67 do not need to have a complex configuration but may have a simple configuration. Accordingly, it is possible to simplify not only the configuration of the strip shape detection device 13 but also the calculation process in the stable rolling control device 14. The reliability of the calculation result is thus improved.

INDUSTRIAL APPLICABILITY

The present invention can be applied to a rolling line and a rolling method which can improve product quality and manufacturing efficiency.

The invention claimed is:

1. A hot rolling line configured to roll a strip by sequentially threading the strip through a plurality of rolling mills arranged in tandem, at least one of the rolling mills including a screw-down device for adjusting a thickness and a shape of the strip, the hot rolling line comprising:

a plurality of roll axis rolls provided between the rolling mills, the split rolls each being capable of rotating about a rotational axis extending parallel to a rotational axis of the rolling mills and coming into contact with the strip;

a pair of left and right torque detectors detecting torques acting on a left end and a right end of the rotational axis of each of the split rolls respectively when the split roll comes into contact with the strip;

a stable rolling control device including, a strip contact roll pick-out unit selecting one or more split rolls in contact with the strip based on the detected torque output from the pair of left and right torque detectors;

a torque difference calculation unit calculating a torque difference between the left and right ends of the split roll selected by the strip contact roll pick-out unit;

a meandering torque elimination unit calculating shape torques by eliminating meandering torques respectively from the detected torques at the left and right ends of the one or more split rolls selected by the strip contact roll pick-out unit, the shape torques being indicative of a torque generated at the left and right ends of the picked-out split roll based on a shape of the strip, and the meandering torques being indicative of a torque generated at the left and right ends of the selected one or more split rolls by meandering of the strip; and a screw-down leveling control unit controlling the screw-down device to control the meandering of the strip by adjusting a control amount of the screw-down device of the at least one of the rolling mills disposed upstream and downstream of the split rolls in a strip rolling direction, on the basis of the torque difference calculated by the torque difference calculation unit, and to also control the shape of the strip by adjusting the control amount of screw-down device of the at least one of the rolling mills disposed upstream and downstream of the split rolls in the strip rolling direction, on the basis of the shape torques calculated by the meandering torque elimination unit.

2. The hot rolling line according to claim 1, wherein the stable rolling control device further includes, a shape torque distribution regression unit calculating an asymmetric strip shape component and a symmetric strip shape component which indicate the shape of the strip, by performing regression on the shape torques calculated by the meandering torque elimination unit, the regression performed by using a polynomial having a predetermined degree, wherein the screw-down leveling control unit controls the shape of the strip by adjusting the control amount of the screw-down device of the at least one of the rolling mills disposed upstream and downstream of the split rolls in the strip rolling direction, on the basis of the asymmetric strip shape component calculated by the shape torque distribution regression unit.

3. The hot rolling line according to claim 2, wherein the stable rolling control device further includes, a meandering torque difference calculation unit calculating a meandering torque difference caused between the left and right ends of the selected one or more split rolls by the meandering of the strip, on the basis of the torque difference calculated by the torque difference calculation unit as well as the asymmetric strip shape component and the symmetric strip shape component calculated by the shape torque distribution regression unit, wherein the screw-down leveling control unit controls the meandering of the strip by adjusting the control amount of the screw-down device of the at least one of the rolling mills disposed upstream and downstream of the split rolls in the strip rolling direction, on the basis of the meandering torque difference calculated by the meandering torque difference calculation unit.

4. The hot rolling line according to claim 3, wherein the meandering torque difference calculation unit calculates a meandering torque difference ratio on the basis of the calculated meandering torque difference and an average value of the torques at the left and right ends of the split roll picked out by the strip contact roll pick-out unit, and the screw-down leveling control unit controls the meandering of the strip by adjusting the screw-down leveling of at least one of the rolling mills disposed upstream and downstream of the split rolls in the strip rolling direction, on the basis of the meandering torque difference ratio calculated by the meandering torque difference calculation unit.

5. The hot rolling line according to claim 1, further comprising:

a pair of upper and lower pinch rolls rotatably supported at least at one of an entry side and a delivery side of one of the rolling mills and configured to guide the strip by pinching the strip from above and below, wherein the split rolls are arranged between the one rolling mill and the pair of pinch rolls provided at the one of the entry side and the delivery side of the one rolling mill, and the screw-down leveling control unit controls the meandering and the shape of the strip by adjusting the control amount of the screw-down device of the at least one of the rolling mill and the pair of pinch rolls disposed upstream and downstream of the split rolls in the strip rolling direction.

6. The hot rolling line according to claim 1, wherein the split rolls picked out by the strip contact roll pick-out unit include only split rolls being in full contact with the strip in a roll width direction or include a split roll being in full contact with the strip in the roll width direction and a split roll being in partial contact with the strip.

7. A hot rolling method of rolling a strip by sequentially threading the strip through a plurality of rolling mills arranged in tandem, the hot rolling method comprising:

bringing a plurality of split rolls into contact with the conveyed strip, the split rolls provided at least in one of spaces between the rolling mills and each rotatably supported about a roll axis parallel to a work roll axis direction of the rolling mills;

detecting torques acting on left and right ends of each of the split rolls respectively when the split roll comes into contact with the strip;

picking out each split roll being in contact with the strip;

calculating a torque difference between the left and right ends of the picked-out split roll;

calculating shape torques by eliminating meandering torques respectively from the torques at the left and right ends of the picked-out split roll, the shape torques generated at the left and right ends of the picked-out split roll by a shape of the strip, the meandering torques generated at the left and right ends of the picked-out split roll by meandering of the strip; and controlling the meandering of the strip by adjusting screw-down leveling of at least one of the rolling mills disposed upstream and downstream of the split rolls in a strip rolling direction, on the basis of the torque difference, and also controlling the shape of the strip by adjusting the screw-down leveling of at least one of the rolling mills disposed upstream and downstream of the split rolls in the strip rolling direction, on the basis of the shape torques.

8. The hot rolling method according to claim 7, further comprising:

calculating an asymmetric strip shape component and a symmetric strip shape component which indicate the shape of the strip, by performing regression on the shape torques by using a polynomial having a predetermined degree, wherein the shape of the strip is controlled by adjusting the screw-down leveling of at least one of the rolling mills disposed upstream and downstream of the split rolls in the strip rolling direction, on the basis of the asymmetric strip shape component.

9. The hot rolling method according to claim 8, further comprising:

calculating a meandering torque difference caused between the left and right ends of the picked-out split roll by the meandering of the strip, on the basis of the torque difference, the asymmetric strip shape component, and the symmetric strip shape component, wherein the meandering of the strip is controlled by adjusting the screw-down leveling of at least one of the rolling mills disposed upstream and downstream of the split rolls in the strip rolling direction, on the basis of the meandering torque difference.

10. The hot rolling method according to claim 9, further comprising:

calculating a meandering torque difference ratio on the basis of the meandering torque difference and an average value of the torques at the left and right ends of the picked-out split roll, wherein the meandering of the strip is controlled by adjusting the screw-down leveling of at least one of the rolling mills disposed upstream and downstream of the split rolls in the strip rolling direction, on the basis of the meandering torque difference ratio.

11. The hot rolling method according to claim 7, wherein a pair of upper and lower pinch rolls is provided, the pinch rolls rotatably supported at least at one of an entry side and a delivery side of one of the rolling mills and configured to guide the strip by pinching the strip from above and below, the split rolls are arranged between the one rolling mill and the pair of pinch rolls provided at the one of the entry side and the delivery side of the one rolling mill, and the meandering and the shape of the strip are controlled by adjusting the screw-down leveling of at least one of the rolling mill and the pair of pinch rolls disposed upstream and downstream of the split rolls in the strip rolling direction.

12. The hot rolling method according to claim 7, wherein the picked-out split rolls include only split roll being in full contact with the strip in a roll width direction or include a split roll being in full contact with the strip in the roll width direction and a split roll being in partial contact with the strip.

* * * * *